United States Patent [19]

Sommers, Jr. et al.

[11] 4,323,342

[45] Apr. 6, 1982

[54] BURNER IGNITION AND CONTROL SYSTEM

[75] Inventors: Edward G. Sommers, Jr.; James G. O'Connor, both of Louisville, Ky.

[73] Assignee: General Electric Company, Louisville, Ky.

[21] Appl. No.: 110,723

[22] Filed: Jan. 9, 1980

[51] Int. Cl.[3] ..... F23M 5/00

[52] U.S. Cl. ..... 431/66; 431/24

[58] Field of Search ..... 431/24, 66, 67, 78

[56] References Cited

U.S. PATENT DOCUMENTS

| | | | |
|---|---|---|---|
| 2,411,642 | 11/1946 | Strobel . | |
| 2,448,475 | 8/1948 | Strobel et al. . | |
| 2,474,941 | 7/1949 | Hasselhorn et al. . | |
| 2,983,314 | 5/1961 | Geldhof et al. . | |
| 3,026,932 | 3/1962 | Algino . | |
| 3,338,288 | 8/1967 | Walker . | |
| 3,393,039 | 7/1968 | Eldridge et al. | 431/70 |
| 3,488,131 | 1/1970 | Myers et al. | 431/24 |
| 3,497,849 | 2/1970 | Place et al. | 337/99 |
| 3,501,253 | 3/1970 | Wade | 431/43 |
| 3,558,110 | 1/1971 | Kushner | 34/45 |
| 3,563,681 | 2/1971 | Hirsbrunner | 431/66 |
| 3,589,846 | 6/1971 | Place et al. | 431/66 |
| 3,597,139 | 8/1971 | Elders | 431/66 |
| 3,600,117 | 8/1971 | Hirsbrunner | 431/66 |
| 3,603,708 | 9/1971 | Good | 431/66 |
| 3,620,659 | 11/1971 | Fox | 431/66 |
| 3,806,308 | 4/1974 | Cahoe et al. | 431/66 |
| 3,807,933 | 4/1974 | Fernstrom | 431/66 |
| 3,862,820 | 1/1975 | Hantack | 431/66 |
| 4,002,419 | 1/1977 | Hantack et al. | 431/67 |
| 4,087,232 | 5/1978 | Budlane | 431/66 |

*Primary Examiner*—Carroll B. Dority, Jr.

*Attorney, Agent, or Firm*—Radford M. Reams

[57] ABSTRACT

A dual solenoid burner control system particularly adapted for a gas clothes dryer. A controlled switching element, such as a triac, is advantageously employed in a circuit arrangement which accomplishes the various operational functions required of such circuits, and which permits the use of single-winding solenoid gas valves and a simple single-pole sensing switch for sensing igniter ignition condition or flame heat. The preferred embodiments interrupt gas flow in the event of triac failure, whether open-circuited or short-circuited. In an additional system function, the change in winding impedance as a solenoid valve operates normally is sensed and advantageously utilized to cause the first valve to close in the event the second valve does not properly operate.

13 Claims, 3 Drawing Figures

BURNER IGNITION AND CONTROL SYSTEM

BACKGROUND OF THE INVENTION

The present invention relates generally to ignition and control systems for operating a burner, and, more particularly, to dual solenoid burner control systems for gas clothes dryers.

A variety of ignition and control systems for gas clothes dryers have been proposed, all having as a general objective the provision of a relatively low-cost system which, at the same time, is reliable and effective. It will be appreciated that reliability is an important consideration, particularly where a gas appliance is involved.

In the interest of surety of operation, it is usual practice to provide such systems with a pair of electromagnetically operated solenoid gas valves arranged in series with the burner gas supply conduit such that fuel can be supplied to the burner only when both valves are open.

Two other usual elements in such systems are an igniter element, such as a resistance glow-type igniter which, when energized, heats to a temperature sufficiently high to ignite gas; and a thermal sensing switch having contacts which are closed when cold and open when hot. Advantageously, the sensing switch is typically positioned so as to be responsive both to the heat from the igniter and to the heat from the burner flame, when present. For low cost, it is desirable to be able to use a thermal sensing switch having single pole contacts.

An additional element of typical prior art systems is a holding or latching circuit arrangement for one of the gas valves arranged such that, during normal operation when a flame has been established, the one gas valve is held in an energized condition only by means of its latching or holding circuit. Even a momentary interruption in electrical power supplied to the circuit causes this valve to close, shutting off of the gas supply to the burner. Thereafter, a proper reignition sequence is required to get gas flow and flame.

In the normal operation of such systems, initially the thermal sensing switch is cold and its contacts are closed. When power is supplied to the system, the igniter and a first gas valve are energized. However, the second gas valve is not energized at this point, and for an initial interval no gas enters the combustion chamber. Typically, during this interval a blower operates and purges the combustion chamber of any unburned fuel which may be remaining from a previous operation. When the igniter exceeds ignition temperature, the thermal switch contacts open. Opening of the thermal switch contacts energizes the second gas valve so that gas is free to enter the combustion chamber and to be ignited. At the same time, the igniter is either fully or partially de-energized, depending upon the particular system, and cools down. However, the thermal mass of the igniter allows it to remain above ignition temperature long enough to ignite the entering gas. After normal ignition, flame heat keeps the contacts of the thermal sensing switch open, even though the igniter itself is no longer fully energized.

These various prior art circuits also deal in various manners with abnormal conditions. One such abnormal condition, already mentioned, is a momentary interruption in electrical power supplied to the system, such as would result with a momentary dryer door opening. When this occurs, the latching or holding circuit for one of the gas valves is broken, shutting off the supply of gas to the burner, and requiring a proper reignition sequence with a purging operation.

Another abnormal condition is failure of the gas to ignite, even though the igniter has reached an ignition condition. In typical circuits, when ignition fails to occur, the thermal sensing switch cools down, and its contacts assume their normal, closed position, causing at least one of the gas valves to close, shutting off the supply of gas to the burner. At this point, the system may recycle for another and subsequent restart attempts, until such time as ignition occurs or another means terminates operation of the system.

By way of example, the following U.S. Patents are identified as disclosing examples of various systems of the general type described above, particularly adapted for gas clothes dryers: Place et al U.S. Pat. Nos. 3,497,849 and 3,589,846; Elders U.S. Pat. No. 3,597,139; Good U.S. Pat. No. 3,603,708; Fox U.S. Pat. No. 3,620,659; Cahoe et al. U.S. Pat. No. 3,806,308; Fernstrom U.S. Pat. No. 3,807,933; and Hantack U.S. Pat. No. 3,862,820. These patents, although all generally similar in function and in components employed, describe a number and variety of circuits for providing the various functional requirements.

These patents also illustrate a number of design principles which have been applied to such circuits. For the holding or latching function mentioned above, at least three approaches have been employed.

A first approach involves providing at least two windings on one of the solenoid gas valves, one of the windings being a holding winding which may be connected directly across the incoming power lines. The holding winding itself is insufficient to actually operate the valve, for which the second winding is provided. As is known, solenoid operated gas valves normally require much more magnetic force to initially operate than to hold in an operated condition. Examples of this first approach are provided by the disclosures of the Elders U.S. Pat. No. 3,597,139 and the Cahoe et al U.S. Pat. No. 3,806,308.

A second approach to providing holding or latching circuit does not require a dual coil gas valve solenoid, and instead relies upon a holding current resistor connected in series with a gas valve winding. The holding current resistor is selected such that current passed therethrough is insufficient to initially cause operation of the gas valve, but sufficient to keep the valve operated once it is operated. A switching means is provided to effectively by-pass the holding current resistor for initially operating the valve. An example of this second type of holding circuit is provided by the disclosure of the Fox U.S. Pat. No. 3,620,659. Further, although not a dual solenoid valve gas dryer control circuit, the disclosure of the Hirschbrunner U.S. Pat. No. 3,600,117 discloses a similar resistor holding circuit for a solenoid fuel valve, wherein a triac bypasses the resistor to initially operate the valve.

A third approach to providing holding or latching circuit employs special relay or switching contacts mechanically connected to and operated by one of the solenoid valves. The electrical connection is such that a circuit to the valve winding is completed through the special contacts. Such a circuit is disclosed in the Place et al U.S. Pat. Nos. 3,497,849 and 3,589,846.

As an example of another usual design principle, for initially energizing the igniter and positively precluding operation of one of the gas valves while the thermal sensing switch contacts are closed, it is typical to electrically connect the igniter and the first valve winding in series between the power input conductors, and to effectively connect the thermal sensing switch contacts in shunt across the second valve winding. With this arrangement, when the thermal sensing switch contacts later open, the igniter is de-energized, and the second solenoid winding is energized.

The present invention provides a system of the general type described above which provides has all of the usually required operational functions, and yet is extremely uncomplicated and low in cost. Further, the present invention allows the use of standard components, such as single winding gas valves and a single pole thermal sensing switch of conventional design. The present invention, in its preferred embodiment, provides the additional function of de-energizing the first solenoid valve should the second solenoid valve fail to operate due to a mechanical malfunction even though the second solenoid valve is energized.

SUMMARY OF THE INVENTION

Accordingly, it is an object of the invention to provide an efficient and low cost dual solenoid valve ignition and control system for a burner, particularly in a gas clothes dryer.

It is another object of the invention to provide such a system which incorporates all of the usual functions such as purging, deactivation upon momentary power interruption, and gas supply termination and attempted restart upon failure to ignite.

It is still another object of the invention to provide such a system which electrically senses proper operation of the second gas valve and de-energizes the first gas valve upon failure of the second gas valve to mechanically operate even though electrically energized.

Briefly stated, and in accordance with the broader concepts of the invention, the present invention resides in a recognition that a controlled switching element such as a triac may advantageously be employed in a simple circuit arrangement which performs all of the functions required, and which permits the use of single winding gas valves and a single pole sensing switch. Not only does the unexpectedly simple circuit of the present invention provide all the functions required, but, in its preferred embodiments, it closes at least one of the valves in the event the triac fails; whether the triac fails in the shorted or the open mode. Further, as mentioned above, the embodiments of the invention provide the additional function of de-energizing the first gas valve in the event the second gas valve mechanically fails to operate, even though electrically energized.

While the controlled switching element used in the preferred control system described herein is a three-terminal semiconductor device known as a triac, it will be appreciated that other solid state thyristor type devices may equally well be employed, as well as thyratrons and suitably connected electromechanical relays. In this regard, it will be appreciated that a triac or equivalent controlled switching element for the purposes of the present invention includes a pair of main switch terminals and a control input terminal, and is operable to conduct and establish an electrically conducting path between the main switch terminals when a signal is applied to the control input terminal with reference to one of the main switch terminals, and operable to interrupt the electrically conducting path when the control input signal is not present. As is known, with a triac, circuit interruption does not occur instantaneously, but occurs, assuming an AC power source, at the first instant the voltage applied across the triac main terminals reduces to zero following the removal of the gating or control signal. However, for practical purposes, insofar as the present invention is concerned, the slight delay in triac turn-off is of no consequence.

Briefly stated, and in accordance with one aspect of the invention, the igniter and one of the valve windings are electrically connected in series between the power input conductors, and the sensing switch contacts are connected in shunt cross the one valve winding. With this arrangement, when the power input conductors are energized and the sensing switch contacts are closed, the igniter is energized but the one valve winding is not energized. When the sensing switch contacts later open, the igniter is effectively de-energized, and the one valve winding is energized.

Additionally, a holding current impedance element and the other of the valve windings are electrically connected in series between the power input conductors. The holding current impedance element is selected such that current passed through the impedance element alone is insufficient to operate the other valve, but sufficient to maintain the other valve in an operated condition once operated.

In accordance with a significant aspect of the invention, a controlled switching element, such as a triac, is provided, and electrically connected so as to conduct and effectively shunt the holding current impedance to cause operation of the other valve when the power input conductors are energized and the sensing switch contacts are closed, and to cease conducting when the sensing switch contacts are open.

In accordance with a more particular aspect of the invention, the series circuit comprising the igniter and the one valve winding and the series circuit comprising the holding current impedance element and the other valve winding are oriented with respect to each other such that the valve windings are connected to respective different ones of the pair of controlled power input conductors. The controlled switching element main terminals are connected between the junction of the igniter with the one valve winding and the junction of the holding current impedance with the other valve winding. With this arrangement, when the power input conductors are energized and the sensing switch contacts are closed, the other one of the valve windings is energized through said controlled switching element and the sensing switch contacts.

In a particularly preferred embodiment of the invention, the one controlled switching element main terminal to which control input signals are referenced is connected to the junction of the igniter with the one valve winding, leaving the other main switch terminal connected to the junction of the holding current impedance with the other valve winding. The control input terminal of the switching element is connected to the same power input conductor to which the igniter and the other valve winding are connected. The various component values of the system are selected such that, when the power input conductors are energized and the sensing switch contacts are closed to energize the igniter, the voltage drop across the igniter applied between the control input terminal and the one main switch terminal causes the controlled switching element to conduct. This energizes the other valve winding (which may also be referred to as the "first" valve winding since it is the first to be energized during normal operation). When the igniter thereafter attains an ignition condition and the sensing switch contacts open in response, the voltage drop across the igniter is insufficient to maintain the controlled switching element in conduction. With the sensing switch contacts open, the one valve winding (which may be referred to as the "second" valve winding) is energized allowing gas to flow to the burner, and the first valve is held in an operated condition by means of the holding circuit.

In accordance with still another aspect of the invention, particularly applicable to the preferred embodiment briefly described immediately above, advantage is taken of a particular characteristic of solenoid operated gas supply valves. In particular, the coil or winding of such a valve winding presents an impedance in the form of an inductance which increases as the valve operates normally and the magnetic core comprising a part of the mechanical valve assembly is drawn by magnetic force into the solenoid coil. In accordance with this particular aspect of the invention, this change in inductance is sensed and utilized to advantage to de-energize the other gas valve in the event the one gas valve mechanically fails to operate, even though electrically energized. With the series connection of the igniter and the one valve winding across the electrical power input conductors, it will be appreciated that the respective voltage drops across the igniter and the one valve winding are apportioned depending upon their respective relative impedances. Specifically, there is a relatively lower drop across the one valve winding and a corresponding relatively higher voltage drop across the igniter when the one valve fails to operate compared to when the one valve operates normally. In accordance with the invention, the various component values of the system are selected such that the relatively higher voltage drop across the igniter when the one valve fails to operate normally causes the controlled switching element to remain in conduction, thereby effectively shunting the other valve winding through the igniter and causing the other valve to close.

It will further be appreciated that, in similar fashion, should the triac for any reason abnormally remain in conduction after the sensing switch contacts are open, for example due to a failure of the triac itself, the other valve winding is shunted through the igniter, causing the other valve to close and positively shutting off supply of gas to the burner.

In another particular embodiment of the invention, the controlled switching element main terminals are reversed with reference to the orientation in the particularly preferred embodiment described above. Specifically, the one of the main switch terminals is connected to the junction of the holding current impedance with the other of the valve windings, and the other main switch terminal is connected to the junction of the igniter with the one valve winding. The control input terminal is connected to the controlled power input conductor to which the holding current impedance and the one valve control winding are connected.

In accordance with still another aspect of the invention, the holding current impedance element connected in series with the other valve winding comprises a pair of series connected impedance elements each having sufficient impedance to limit current through the other valve winding below that which is necessary to operate the other of the valves. With this arrangement, should either of the pair of series connected impedance elements itself fail by shorting, proper holding circuit function will continue. In particular, the other (first) gas valve will not inadvertently be operated until the triac or other controlled switching element conducts.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
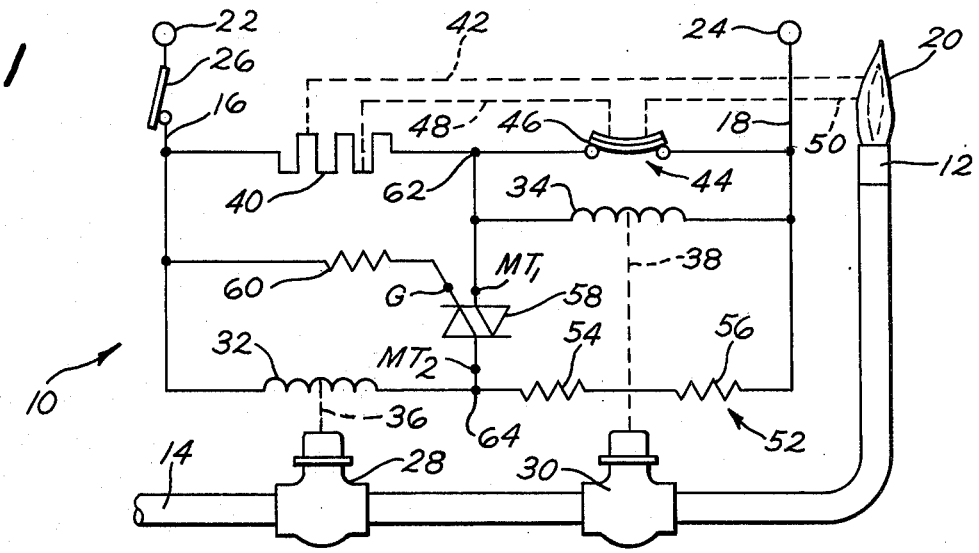
FIG. 1 is a schematic diagram of an ignition and control system illustrating the presently preferred form of the invention.

Referring now to the drawings wherein identical reference numerals denote similar or corresponding elements throughout the three figures, FIG. 1 illustrates an ignition and control system 10 for operating a burner, generally designated 12, from a fuel supply conduit 14 and a pair of controlled electrical power input conductors 16 and 18. The burner 12, when ignited, produces a flame 20.

In accordance with conventional practice, the controlled power input conductors 16 and 18 are supplied from 120 volt AC power input terminals 22 and 24 through various control switches represented in FIG. 1 by the single switch 26. It will be appreciated that the switch 26 is representative of various conventional switching elements provided both for normal operational and for safety purposes. Examples are timer switches, thermostatic temperature control switches, dryness sensing switching devices, door switches and thermal overload switches. In any event, it will be appreciated that when circuitry external to the present ignition and control system desires gas flame heat, it calls for such heat by supplying electrical power to the conductors 16 and 18.

Gas supply to the burner 12 from the fuel supply conduit 14 is controlled by a pair of electromagnetically operated solenoid valves 28 and 30 connected in series with the conduit 14 and operable to supply fuel to the burner 12 only when both of the valves 28 and 30 are open. The valves 28 and 30 have respective solenoid windings 32 and 34, with the operating connection between the windings and valves represented by respective dash lines 36 and 38.

An igniter 40 is provided to ignite fuel issuing from the burner 12, and is suitably mechanically positioned with respect to the burner 12 to accomplish this purpose as is represented by a dash line 42. The igniter 40 is preferably a glow-type resistance igniter which, within a few seconds after energization, reaches a temperature sufficiently high to ignite gas issuing from the burner 12. As is known, such glow-type resistance igniters have a fairly high resistance-temperature coefficient, having a substantially lower resistance when fully energized and hot than when cooler. Such an igniter, when hot, typically draws three to five amperes from an 120 volt AC line, for an effective resistance of twenty-four to forty ohms. When cold, the igniter 40 typically has a resistance of one hundred to eight hundred ohms. While particular advantage of this resistance coefficient characteristic of the igniter 40 is taken in the circuits described herein, in accordance with the broader aspects of the invention, other types of igniters may as well be employed through suitable circuit arrangement, such as spark igniters.

A conventional radiant heat sensing switch 44 has normally closed contacts which open either when the igniter 40 is in an ignition condition or when a flame 20 is present. In FIG. 1, the sensing switch 44 comprises a representative bimetallic element 46 which mechanically flexes to interrupt the circuit when hot. A dash line 48 represents the heat transfer path by which the sensing switch 44 responds to heat from the igniter 40, and a dash line 50 represents the heat transfer path by which the sensing switch responds to heat from the flame 20. Further details of one particular sensing switch which has been found to be suitable in the system of the present invention may be had by reference to the Place et al U.S. Pat. No. 3,497,849. Another example of a suitable radiant heat switch is disclosed in the Budlane U.S. Pat. No. 4,087,232. It will be appreciated that the particular details of the sensing switch 44 are not important insofar as the present invention is concerned, and that various forms of switch are possible, not necessarily bimetallic or even thermal sensing.

In FIG. 1, the igniter 40 and one of the valve windings (in this particular embodiment, the valve winding 34) are electrically connected in series between the controlled power input conductors 16 and 18, and the sensing switch 44 contacts are connected in shunt across the one valve winding 34. The one valve winding 34 may also be referred to as the "second" winding because the associated valve 30 is the second to open during normal operation.

Connected in series with the other of the valve windings (in this particular embodiment, the valve winding 32) between the controlled power input conductors 16 and 18 is a holding current impedance element generally designated 52. The holding current impedance element 52 is selected such that current passed through the impedance element 52 alone is insufficient to operate the other 28 of the valves, but sufficient to maintain the other 28 of the valves in its operated condition once operated. The other valve winding 32 may be referred to as the "first" valve winding because its associated solenoid valve 28 is the first to open during normal operation of the circuit.

More particularly, the holding current impedance element 52 may be seen to comprise a pair of series connected impedance elements 54 and 56, shown as resistors, each having a sufficient impedance to limit current through the other valve winding 32 below that which is necessary to operate the other valve 28. This provides an additional safety feature in that should either of the resistors 54 or 56 fail by shorting, the holding circuit continues to function normally. In particular, the valve 28 would not open prematurely.

In accordance with the invention, a controlled switching element, shown as a representative triac 58, is electrically connected so as to conduct and effectively shunt the holding current impedance 52 to cause operation of the other valve 28 when the controlled power input conductors 16 and 18 are energized and the sensing switch 44 contacts are closed, and to cease conducting when the sensing switch 44 contacts are open.

More particularly, the triac 58 has a pair of main switch terminals $MT_1$ and $MT_2$, and a control input terminal G, which in conventional nomenclature is the triac gate terminal. A current limiting resistance 60 is connected in series with the triac 54 gate (G) terminal.

A conventional triac is triggered into conduction for either polarity between its main terminals $MT_1$ and $MT_2$ when triggered. A triac is triggered when a signal in the form of a current is applied to its gate (G) terminal with reference to one of the main terminals, $MT_1$. The gating signal may be of either polarity. Thus, the triac is an AC device, in that triggering and conduction can occur with all polarity possibilities, although it will be appreciated that the triac is more sensitive to some biasing conditions than to others. Following removal or termination of the gating or trigger signal, the triac 58 ceases conducting at the first instant the voltage across the main terminals $MT_1$ and $MT_2$ reduces to zero as a consequence of operation from an AC supply.

In the particular FIG. 1 connection of the triac 58 to accomplish the desired functions, the valve windings 32 and 34 are connected to respective different ones of the pair of controlled power input conductors 16 and 18. Specifically, the one valve winding 34 is connected to the power input conductor 18, and the other valve winding 32 is connected to the power input conductor 16. The controlled switching element main terminals $MT_1$ and $MT_2$ are connected between the junction 62 of the igniter 40 with the one valve winding 34 (and with the sensing switch 44) and the junction 64 of the holding current impedance 52 with the other valve winding 32. As a result, when the controlled power input conductors 16 and 18 are energized and the sensing switch contacts 44 are closed, the other valve winding 32 is energized through the triac 58 and the sensing switch 44 contacts.

More specifically, in FIG. 1 the one triac main terminal $MT_1$ is connected to the junction 62 of the igniter 40 with the one valve winding 34, and the other triac main terminal $MT_2$ is correspondingly connected to the junction 64 of the holding current impedance element 52 with the other valve winding 32. The triac 58 control input or gate (G) terminal is connected through a current limiting resistor 60 to the controlled power input conductor 16 to which the igniter 40 and the other valve winding 32 are connected. Further, the various component values in FIG. 1 are selected such that, when the power input conductors 16 and 18 are energized and the sensing switch 44 coontacts are closed to energize the igniter 40, the voltage drop across the igniter 40 applied between the control input or gate (G) terminal and the one main switch terminal $MT_1$ of the triac 58 causes the triac 58 to conduct, and, when the igniter 40 thereafter attains an ignition condition and the sensing switch 44 contacts open in response, the voltage drop across the ignition 40 is insufficient to maintain the triac 58 in conduction.

Further, the solenoid valves 28 and 30 have the characteristic that the inductance of the respective windings 32 and 34 increases when the valve operates normally and the valve core (not shown) is electromechanically pulled into the solenoid winding. In the FIG. 1 embodiment, this characteristic of the second valve 30 with its associated winding 34 is utilized to advantage to de-energize the first valve winding 32 to cause the first valve 28 to close in the event the second valve 30 mechanically fails to operate even though its winding 34 is energized.

It will be appreciated that, when the sensing switch 44 contacts are open and the igniter 40 and the winding 34 are connected in series, the line voltage is apportioned between the igniter 40 and the winding 34, with the precise voltage drop across each dependent upon their relative impedance values. When the valve 30 operates normally and the inductance of the winding 34 increases, the voltage drop across the winding 34 is higher and the voltage drop across the igniter 40 is correspondingly lower than in the situation when the valve 30 fails to operate normally and the impedance of the winding 34 remains lower. Taking advantage of this, the various component values of the system 10 are selected such that the relatively higher voltage drop across the igniter 40 when the valve 30 fails to operate normally causes the triac 58 to remain in conduction, even though the sensing switch 44 contacts are open. This effectively shunts the other valve winding 32 through the igniter 40 and the triac 58, causing the other valve 28 to close.

The operation of the FIG. 1 embodiment of the invention will now be summarized.

When heat is appropriate, the other control circuitry (not shown) of the dryer calls for heat by closing the representative switch 26, energizing the controlled electrical power input conductors 16 and 18 from a 120 volt AC supply connected to the terminals 22 and 24. Initially, the sensing switch 44 contacts are closed, completing a direct connection to the igniter 40 which is therefore fully energized and begins heating. As indicated by the respective dash lines 48 and 42, igniter 40 heat is applied both the the bimetallic element 46 and to the position of the intended flame 20. At the same time the igniter 40 is beginning to heat, the voltage thereacross, which is essentially full line voltage, is applied between the triac 58 gate (G) and one main terminal $MT_1$, through the current limiting resistor 60. The resistor 60 is appropriately selected to protect the triac 58, while allowing sufficient current to pass for reliable gating.

With the triac 58 in conduction, the first valve winding 32 is energized with substantially full line voltage through the triac 58 and the sensing switch 44 contacts. This causes the first gas valve 28 to operate. However, the second gas valve 30 remains closed because its winding 34 is directly shunted by the sensing switch 44 contacts. Thus, no fuel issues from the burner 12.

When the igniter 40 reaches ignition condition as sensed by the bimetallic element 46 via the representative dash line 48, the sensing switch 44 contacts open, placing the igniter 40 and second valve winding 34 effectively in series. Sufficient current passes through the igniter 40 to energize the second valve winding 34 and cause the second valve 30 to operate. With both valves 28 and 30 open, fuel is supplied to the burner 12 and issues therefrom.

Although the igniter 40 is no longer fully energized, it has sufficient thermal mass to remain above ignition temperature long enough to establish the flame 20. Heat from the flame 20 applied to the bimetallic element 46 via the representative dash line connection 50 keeps the sensing switch 44 contacts open.

At the same time, reduced voltage across the igniter 40, now connected in series with the fairly high impedance of the second winding 34, furnishes insufficient gating signal to the triac 58, specifically across the G and $MT_1$ terminals thereof, and the triac 58 ceases conducting. The first gas valve 28 however remains in its operated condition as a result of the holding circuit comprising the holding current impedance element 52.

For normal termination of operation, the representative switch 26 opens, removing all power to the control system 10, causing both gas valves 28 and 30 to close, shutting off the supply of fuel to the burner 12. After a brief time, the bimetallic element 46 cools and the sensing switch 44 contacts reclose, readying the system 10 for another operational cycle.

In the event of a momentary interruption in power for any reason, the representative switch 26 momentarily opens, removing power from the control power input conductors 16 and 18. Even though the thermal mass of the bimetallic element causes the contacts of the sensing switch 44 to remain open such that the second gas valve winding 34 is immediately re-energized upon restoration of power across the conductors 16 and 18, the holding circuit for the first valve winding 32 is broken, causing the first valve 28 to cease operating, terminating the supply of gas to the burner 12. A purging interval then begins during which the bimetallic element 46 cools, eventually reclosing the contacts of the switch 44. At this point, the second valve winding 34 is de-energized, closing the second valve 30, and the igniter 40 is energized, thus beginning a normal ignition sequence.

If the triac 58 should fail, either by opening or shorting, supply of gas to the burner 12 is positively precluded.

If the triac 58 fails by open-circuiting, then the first gas valve 28 can never be initially operated, and no gas is supplied to the burner 12 even when the second valve 30 operates upon opening of the sensing switch 44 contacts.

If, on the other hand, the triac 58 fails in a shorted mode, the first valve winding 32 is initially energized as before, operating the first gas valve 28. However, upon opening of the sensing switch 44 contacts and energization of the second valve winding 34, the igniter 40 rapidly cools and presents a relatively low resistance such that the first valve winding 32 is shunted or bypassed by the series combination of the igniter 40 and the triac 58. The value of the holding current impedance element 52 is selected such that the first valve 28 is allowed to close when thus shunted.

If the triac 58 is functioning normally but the second gas valve 30 fails to mechanically operate even though its winding 34 is energized, as described above the relatively lower impedance presented by the winding 34 and the consequently relatively lower votage drop thereacross than normal causes a correspondingly higher voltage drop across the igniter 40 than is normal, maintaining sufficient gating signal to the triac 58, causing it to remain in conduction. As the igniter 40 cools, the igniter 40 and the triac 58 shunt the first valve winding 32, causing the first valve 28 to close.

By way of example, without any way intending to limit the scope of the claims, the following component values have been found suitable in the practice of the present invention. The gas valves 28 and 30 are identical, with winding 32 and 34 impedances of approximately 900 ohms. When the second gas valve 38 is operated, its winding 34 presents an impedance of approximately 2000 ohms. Gas valve type number 25K 49A-28, manufactured by White-Rodgers, has been found to be suitable. The pair of resistors 54 and 56 comprising the holding current impedance element 52 have a combined resistance of 1600 ohms. The current limiting resistor 60 for the triac 58 gate (G) terminal may be 22 K ohms. The triac 58 may be a Type No. MAC92-6, and the igniter a GLO-BAR ®, drawing 3–5 amperes when fully energized and hot with an effective on resistance of 24–40 ohms, and a resistance of 100–800 ohms when cold.

Figure 2:
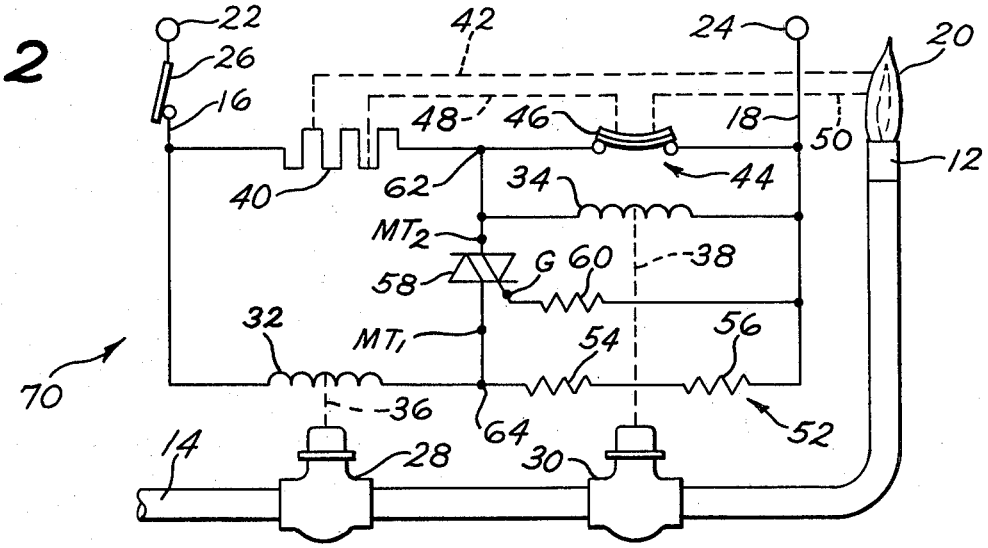
FIG. 2 illustrates another embodiment of the invention which has most of the functional features of the FIG. 1 embodiment.

Referring now to FIG. 2, a system 70 in accordance with another embodiment of the invention differs from the FIG. 1 embodiment in that the orientation of the triac main terminals $MT_1$ and $MT_2$ is reversed, and a different triac gating arrangement is employed. Specifically, the triac terminal $MT_1$ is connected to the junction 64 of the first valve winding 32 with the holding current impedance element 52. Correspondingly, the other triac main terminal $MT_2$ is connected to the junction 62 of the igniter 40 with the second valve winding 34. The triac gate (G) terminal is connected through the current limiting resistor 60 to the power input conductor 18 to which the holding current impedance 52 and the one valve winding 34 are connected.

The operation of the FIG. 2 embodiment is generally similar to that of the FIG. 1 embodiment, with the exception that the function of shunting the first valve winding 32 should the second valve 30 fail to operate is not provided.

In particular, operation of the FIG. 2 embodiment is as follows. When power is applied, the igniter 40 and sensing switch 44 (assumed closed) are placed across the line. The igniter 40 then heats to ignition temperature. At the same time, gas valve winding 32 and triac 58 are connected across the line through the sensing switch 44 contacts. Gate current-limiting resistor 60 causes the triac 58 to conduct and energize the gas valve winding 32.

Triggering is accomplished as follows: With the triac 58 in a non-conducting state, it exhibits a high resistance between $MT_1$ and $MT_2$. Thus, when the power is applied, most of the voltage drop is across the triac 58. Since, for all practical purposes, the gate limiting resistor 60 is connected across the triac 58, it too has most of the line voltage across it and current flows into the gate of the triac 58 driving it into conduction. Once the triac 58 begins conduction, the voltage across it drops to approximately one volt. This voltage is also present across the gate current-limiting resistor 60, the value of which is chosen to keep the triac 58 in the conduction state.

When the igniter 40 reaches ignition temperature, the sensing switch 44 contacts open. The gas valve winding 34 is no longer shunted and opens.

Most of the line voltage is present across gas valve winding 34. Gas valve winding 32 remains energized through holding resistors 54 and 56. However, since the triac $MT_2$ terminal and gate current limiting resistor 60 are connected across the gas valve winding 34, every time the AC voltage across the valve winding 34 goes through zero in a positive direction relative to neutral (terminal 24) the triac 58 conducts. The conduction path is through the igniter 40 and holding resistors 54 and 56 (the path of least resistance). The igniter 40 and gas valve winding 32 are effectively connected in parallel, as are gas valve 34 and holding resistors 54 and 56. The overall effect is to increase the voltage across the holding resistors 54 and 56 every other AC half cycle and cause gas valve winding 32 to conduct only in half cycles. Gas valve winding 32 remains open however. A non-preferred effect is the higher wattage dissipation requirement of holding resistors 54 and 56 than in the embodiment of FIG. 1.

Figure 3:
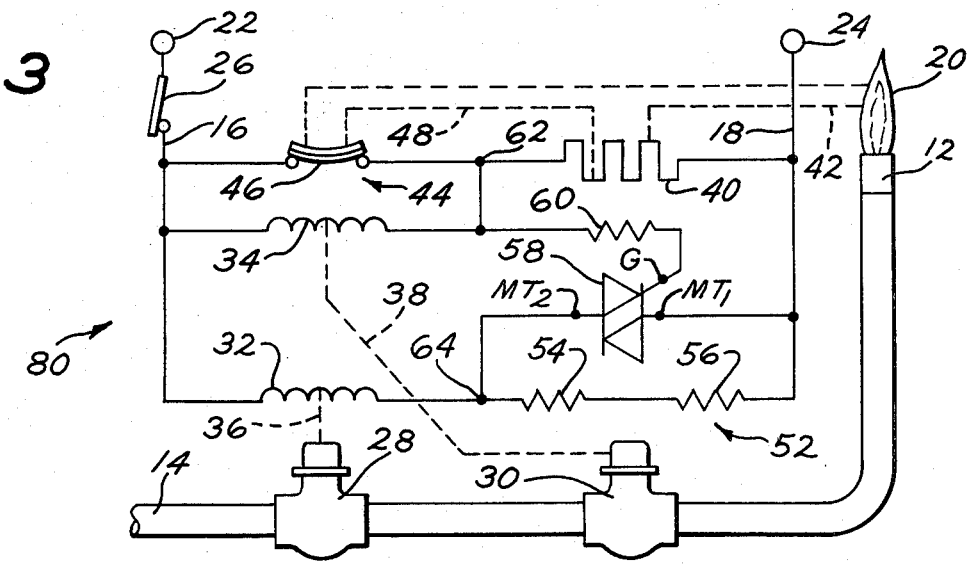
FIG. 3 is a schematic diagram of still another embodiment of the invention.

FIG. 3 illustrates still another embodiment of the invention in accordance with the broader aspects thereof. In particular, the triac 58 is connected such that the holding current impedance 52 is shunted so as to fully energize the first valve winding 32 when power is initially supplied to the circuit and the sensing switch 44 contacts are closed. When the sensing switch 44 contacts open, the triac 58 ceases conducting. However, the FIG. 3 embodiment is not presently preferred in that a number of advantageous functional features of the previous embodiments are not present.

In the particular FIG. 3 arrangement, both the first and second valve windings 32 and 34 are, for purposes of illustration, connected to the same one of the power input conductors, specifically the power input conductor 16. The connection of the triac main terminals $MT_1$ and $MT_2$ is quite different compared to the FIG. 1 and 2 embodiments in that in FIG. 3 these terminals are connected to directly bypass the holding current impedance element 52, and are not connected to the series circuit comprising the igniter 40 and the second valve winding 34. The triac terminal $MT_1$ to which the gate control signal is referenced is connected to the power input conductor 18 to which the igniter 40 and the holding current impedance element 52 are connected, and the triac gate (G) terminal is connected through the current limiting resistance 60 to the junction 62 of the igniter 40 with the sensing switch 44. Thus, the triac 58 is gated when the sensing switch 44 contacts are closed. A disadvantage of the FIG. 3 embodiment, which serves to point out the particular advantages of the embodiments of FIGS. 1 and 2, is that, should the triac 58 fail in a shorted mode, then the first valve winding 32 is fully energized whenever the controlled power input conductor 16 and 18 are energized.

The present invention therefore provides an effective ignition and control system for operating a burner, particularly in a gas dryer, which satisfies all of the functional and safety requirements of such systems. In particular, the present invention advantageously uses the characteristics of a switching element such as a triac, and allows the use of standard components, including single-winding gas valves and a single pole thermal sensing switch of conventional design. Additionally, the preferred embodiment illustrated in FIG. 1, provides the additional function of de-energizing the first solenoid valve should the second solenoid valve fail to operate due to any mechanical malfunction even though the second solenoid valve is energized.

While specific embodiments of the invention have been illustrated and described herein, it is realized that modifications and changes will occur to those skilled in the art. It is, therefore, to be understood that the appended claims are intended to cover all such modifications and changes as fall within the true spirit and scope of the invention.

What is claimed is:

1. An ignition and control system for operating a burner from a fuel supply conduit and a pair of controlled electrical power input conductors, said system comprising:

a pair of electromagnetically operated solenoid valves each having a winding for opening the respective valve when energized, said valves connected in series with the conduit and operable to supply fuel to the burner only when both valves are open;

an electrically operated igniter for igniting fuel issuing from the burner;

a sensing switch having normally closed contacts which open either when said igniter is in an ignition condition or when a flame is present;

said igniter and one of said valve windings being electrically connected in series between the power input conductors, and said sensing switch contacts being connected in shunt across said one of said valve windings, such that, when the power input conductors are energized and said sensing switch contacts are closed, said igniter is energized and said one of said valve windings is not energized, and, when the power input conductors are energized and said sensing switch contacts are open, said igniter is effectively de-energized and said one of said valve windings is energized;

a holding current impedance element electrically connected in series with the other of said valve windings between the power input conductors, said holding current impedance element being selected such that current passed through said impedance element alone is insufficient to operate the other of said valves, but sufficient to maintain the other of said valves in an operated condition once operated;

a controlled switching element having a pair of main switch terminals and a control input terminal, said controlled switching element operable to conduct between said main switch terminals when a signal is applied to said control input terminal with reference to one of said main switch terminals, and operable to cease conducting when the control input signal is not present; and said controlled switching element being electrically connected so as to conduct and effectively shunt said holding current impedance to cause operation of the other of said valves when the power input conductors are energized and said sensing switch contacts are closed, and to cease conducting when said sensing switch contacts are open.

2. An ignition and control system according to claim 1, wherein said controlled switching element comprises a triac.

3. An ignition and control system according to claim 1, wherein said igniter comprises a glow-type resistance igniter having a lower resistance when fully energized and hot than when cooler.

4. An ignition and control system according to claim 1, wherein:

said valve windings are connected to respective different ones of the pair of controlled power input conductors; and said controlled switching element main terminals are connected between the junction of said igniter with said one of said valve windings and the junction of said holding current impedance with said other of said valve windings such that, when the power input conductors are energized and said sensing switch contacts are closed, said other one of said valve windings is energized through said controlled switching element and said sensing switch contacts.

5. An ignition and control system according to claim 4, wherein:

said one of said controlled switching element main switch terminals is connected to the junction of said igniter with said one of said valve windings;

said controlled switching element control input terminal is connected to the controlled power input conductor to which said igniter and said other valve winding are connected; and the various component values of said system are selected such that, when the power input conductors are energized and said sensing switch contacts are closed to energize said igniter, the voltage drop across said igniter applied between said control input terminal and said one of said main switch terminals causes said controlled switching element to conduct, and, when said igniter thereafter attains an ignition condition and said sensing switch contacts open in response, the voltage drop across said igniter is insufficient to maintain said controlled switching element in conduction.

6. An ignition and control system according to claim 5, wherein:

said one of said valve windings assumes either of at least two distinct impedances depending upon whether the one valve is open or closed, one of the distinct impedances being relatively lower and occurring when the one valve is closed, and the other of the distinct impedances being relatively higher and occurring when the one valve operates normally to open, such that, in the event the one valve fails to operate normally even though said sensing switch contacts open and said one valve winding is energized, there is a relatively lower voltage drop across said one valve winding and a corresponding relatively higher voltage drop across said igniter than when the one valve operates normally; and the various component values of said system are selected such that the relatively higher voltage drop across said igniter when the one valve fails to operate normally causes said controlled switching element to remain in conduction even though said sensing switch contacts are open, thereby effectively shunting said other valve winding through said igniter and causing the other valve to close.

7. An ignition and control system according to claim 4, wherein:

said one of said controlled switching element main switch terminals is connected to the junction of said holding current impedance with said other of said valve windings; and said control input terminal of said controlled switching element is connected to the controlled power input conductor to which said holding current impedance and said one valve winding are connected.

8. An ignition and control system according to claim 1, wherein said holding current impedance element comprises a pair of series-connected impedance elements each having sufficient impedance to limit current through said other of said valve windings below that which is necessary to operate the other of said valves.

9. An ignition and control system for operating a burner from a fuel supply conduit and a pair of controlled electrical power input conductors, said system comprising:

a pair of electromagnetically operated valves each having a winding for opening the respective valve when energized, said valves connected in series with the conduit and operable to supply fuel to the burner only when both valves are open;

an electrically operated igniter for igniting fuel issuing from the burner;

a sensing switch having normally closed contacts which open either when said igniter is in an ignition condition or when a flame is present;

said igniter and one of said valve windings being electrically connected in series between the power input conductors, and said sensing switch contacts connected in shunt across said one of said valve windings, such that, when the power input conductors are energized and said sensing switch contacts are closed, said igniter is energized and said one of said valve windings is not energized, and, when the power input conductors are energized and said sensing switch contacts are open, said igniter is effectively de-energized and said one of said valve windings is energized;

a holding current impedance element electrically connected in series with the other of said valve windings between the power input conductors, said other of said valve windings being connected to a different one of the power input conductors than said one of said valve windings, and said holding current impedance element being selected such that current passed through said impedance element alone is insufficient to operate the other of said valves, but sufficient to maintain the other of said valves in an operated condition once operated;

a controlled switching element having a pair of main switch terminals and a control input terminal, said controlled switching element operable to conduct between said main switch terminals when a signal is applied to said control input terminal with reference to one of said main switch terminals, and operable to cease conducting when the control input signal is not present;

one of said controlled switching element main switch terminals being connected to the junction of said igniter with said one of said valve windings, the other of said controlled switching element main switch terminals being connected to the junction of said holding current impedance with said other of said valve windings, and said controlled switching element control input terminal being connected to the controlled power input conductor to which said igniter and said other valve winding are connected; and the various component values of said system being selected such that when the power input conductors are energized and said sensing switch contacts are closed to energize said igniter, the voltage drop across said igniter applied between said control input terminal and said one of said main switch terminals causes said controlled switching element to conduct and effectively shunt said holding current impedance by establishing an energizing path for said other valve winding through said sensing switch contacts to cause operation of the other of said valves, and, when said igniter thereafter attains an ignition condition and said sensing switch contacts open in response, the voltage drop across said igniter is insufficient to maintain said controlled switching element in conduction.

10. An ignition and control system according to claim 9, wherein said controlled switching element comprises a triac.

11. An ignition and control system according to claim 9, wherein said igniter comprises a glow-type resistance igniter having a lower resistance when fully energized and hot than when cooler.

12. An ignition and control system according to claim 9, wherein:

said one of said valve windings assumes either of at least two distinct impedances depending upon whether the one valve is open or closed, one of the distinct impedances being relatively lower and occurring when the one valve is closed, and the other of the distinct impedances being relatively higher and occurring when the one valve operates normally to open, such that, in the event the one valve fails to operate normally even though said sensing switch contacts open and said one valve winding is energized, there is a relatively lower voltage drop across said one valve winding and a corresponding relatively higher voltage drop across said igniter than when the one valve operates normally; and the various component values of said system are selected such that the relatively higher voltage drop across said igniter when the one valve fails to operate normally causes said controlled switching element to remain in conduction even though said sensing switch contacts are open, thereby effectively shunting said other valve winding through said igniter and causing the other valve to close.

13. An ignition and control system according to claim 9, wherein said holding current impedance element comprises a pair of series-connected impedance elements each having sufficient impedance to limit current through said other of said valve windings below that which is necessary to operate the other of said valves.

* * * * *